US006048278A

United States Patent [19]

Meyer et al.

[11] Patent Number: 6,048,278

[45] Date of Patent: Apr. 11, 2000

[54] METAL WOOD GOLF CLUBHEAD

[75] Inventors: Dean E. Meyer, LaGrange Park, Ill.; Stephen J. Davis, Washington Crossing; Richard P. Hulock, Quakertown, both of Pa.

[73] Assignee: Prince Sports Group, Inc.

[21] Appl. No.: 09/007,957

[22] Filed: Jan. 16, 1998

Related U.S. Application Data

[63] Continuation of application No. 08/745,348, Nov. 8, 1996, abandoned.

[51] Int. Cl.[7] ..... A63B 53/04

[52] U.S. Cl. ..... 473/345; 473/349

[58] Field of Search ..... 473/324, 325, 473/345, 346, 349, 335, 341, 290, 291, 256

[56] References Cited

U.S. PATENT DOCUMENTS

| | | | |
|---|---|---|---|
| 4,214,754 | 7/1980 | Zebelean . | |
| 4,850,593 | 7/1989 | Nelson . | |
| 5,186,465 | 2/1993 | Chorne | 473/350 |
| 5,271,620 | 12/1993 | Moriguchi et al. | 473/324 |
| 5,294,037 | 3/1994 | Schmidt . | |
| 5,310,186 | 5/1994 | Karsten . | |
| 5,316,298 | 5/1994 | Hutin et al. . | |
| 5,346,217 | 9/1994 | Tsuchiya et al. | 473/345 |
| 5,354,054 | 10/1994 | Atkatsuka et al. . | |
| 5,480,152 | 1/1996 | Schmidt et al. . | |
| 5,527,034 | 6/1996 | Ashcraft et al. | 473/350 X |
| 5,630,765 | 5/1997 | Moore | 473/341 X |

FOREIGN PATENT DOCUMENTS

| | | |
|---|---|---|
| 0662329 | 7/1995 | European Pat. Off. . |
| 2712197 | 5/1995 | France . |
| 29507984 | 9/1995 | Germany . |

OTHER PUBLICATIONS

Matsuo Article,_Golf Digest_, "The Taylor Made V Metal vs. The Big Bertha", pp. 60–68, May 1992.

*Primary Examiner*—Sebastiano Passaniti

*Attorney, Agent, or Firm*—Skadden, Arps, Slate, Meagher & Flom LLP

[57] ABSTRACT

A metal wood golf clubhead has a length "L" representing the distance, measured perpendicular to the centerline, between the heel and toe; a rearmost point that lies at a distance "A", measured perpendicular to said centerline, from the heel; and a rear edge having a radius of curvature R2, in the region of the rearmost point. In accordance with one aspect of the invention, the distance "A" from the heel to the rearmost point on the clubhead rear edge is at least 60 mm and/or at least 56% of the overall clubhead length "L". In accordance with another aspect of the invention, the clubhead has a volume of at least 180 $cm^3$, the center of curvature of the rear edge, in the region of the rearmost point, is offset from the club's centerline CL toward the toe, and the radius of curvature R2 in the region of the rearmost point is less than 41 mm. The club has a geometry where the body curves relatively sharply beyond the toe end of the face to extend rearwardly. Accordingly, the distance between the toe end of the club face and the tip of the toe portion is less than 6 mm, and the club has a large club face-to-volume ratio, i.e., greater than 13:1.

25 Claims, 5 Drawing Sheets

METAL WOOD GOLF CLUBHEAD

The present application is a continuation of U.S. application Ser. No. 08/745,348, filed Nov. 8, 1986 now abandoned.

BACKGROUND OF THE INVENTION

The present invention relates to metal wood golf clubs, and particularly to drivers, 3 woods, and 4 woods.

In the game of golf, the driver produces the greatest distance of ball travel, and therefore is normally the club of choice when teeing off on par 4 and par 5 holes. It is usually difficult to hit the ball with a driver off the fairway or rough, and for those situations the greatest distance, when conditions allow, can be attained by hitting a 3 wood or 4 wood (herein referred to as "fairway woods").

In recent years, the traditional wooden heads of the driver and fairway woods have been replaced by heads having a shell made of metal, such clubs being referred to as "metal woods". The use of metal in place of a solid wood head allows greater variability in the design of clubhead's shape, weight, and balance.

The trend has been to make the club head bigger, and the shaft longer, while reducing overall weight so as not to increase the swing weight. The advent of titanium composite materials has allowed club heads to exceed 250 cc in volume, the previous practical limit with steel club heads. Thus, some contemporary club heads exceed 300 cc, evidently based on a theory that "bigger is better". However, a larger club head size, while more stable due to a greater inertia, is not necessarily better, because increasing size makes the club more cumbersome to maneuver and "get square" at impact.

While drivers and fairway woods have the potential to hit the ball farther, the longer shaft of the driver makes it the most difficult golf club for most players to control, resulting in frequent hooks, slices, and other misdirected hits. Similarly, due to their longer shafts, fairway woods tend to be more difficult to control than irons. It would therefore be desirable to provide a metal wood driver and fairway woods that are more stable and easier to swing.

SUMMARY OF THE INVENTION

The present invention is a wood-type golf club which is stable, easy to maneuver, and which at the same time makes it easier to hit the ball. More particularly, a club head according to the present invention has a geometry which produces a very large hitting face relative to the overall volume of the club head.

Studies have shown that a typical golfer tends to strike the ball not in the geometric center of the club face, but rather, towards the toe. The present invention relocates the center of gravity to a position approximating the average location of ball impact. The present invention also provides a club face in which the vertical apex is offset towards the toe, also lying closer to the location of average ball impact, thereby providing a bigger target to hit the ball. The present invention thereby makes it easier for the average golfer to hit a good shot.

More particularly, the present clubhead has a shape in which a minimal volume exists beyond the toe end of the club face, to produce a relatively large face-to-volume ratio. At the toe end, the body of the club curves relatively sharply, and thereafter extends, at a relatively large curvature radius, rearwardly. In contrast, conventional woods have a toe end which, at the toe end of the club face, curves more gradually, such that a substantial volume of the club body lies forward of the club face. Clubs with larger hitting areas thus tend to have larger volumes, making the clubs more difficult to maneuver.

Thus, in accordance with one aspect of the invention, the clubhead utilizes the foregoing geometry to produce a face size greater than 3800 $mm^2$, and preferably has a volume of less than 300 cc. In accordance with another aspect of the invention, the clubhead has a volume greater than 250 cc and utilizes the foregoing geometry to produce a face-to-volume ratio greater than 13:1, and most preferably greater than 13.5:1. In accordance with another aspect of the invention, the clubhead has a face size greater than 3600 $mm^2$ and a face-to-volume ratio greater than 13.1, and most preferably greater than 13.5. In accordance with another aspect of the invention, the clubhead has a face greater than 3400 $mm^2$ and a volume of 240 cc or less. The structure of the clubhead is described further below.

A metal wood golf clubhead has a length "L" representing the distance, measured perpendicular to the centerline of the face projected perpendicularly rearward, between the heel and toe; a rearmost point that lies at a distance "A", measured perpendicular to the centerline, from the heel; and a rear edge having a radius of curvature R2 in the region of the rearmost point.

In accordance with one aspect of the invention, the distance "A" from the heel to the rearmost point on the clubhead rear edge is at least 60 mm and/or at least 56% of the overall clubhead length "L". In accordance with another aspect of the invention, the clubhead has a volume of at least 180 $cm^3$, the rear edge center of curvature, in the region of the rearmost point, is offset from the club's centerline CL toward the toe, and the radius of curvature R2 in the region of the rearmost point is less than 40.0 mm.

The foregoing geometry has the effect of locating more mass near the toe of the club, advancing the center of gravity. Thus, for the average player, the center of gravity is closer to the actual point of ball impact. Preferably, the clubhead has an inset hosel, and is utilized with a lightweight shaft.

For a better understanding of the invention, reference is made to the following detailed description of a preferred embodiment, taken in conjunction with the drawings accompanying the application.

DETAILED DESCRIPTION OF THE PREFERRED EMBODIMENTS

Figure 1:
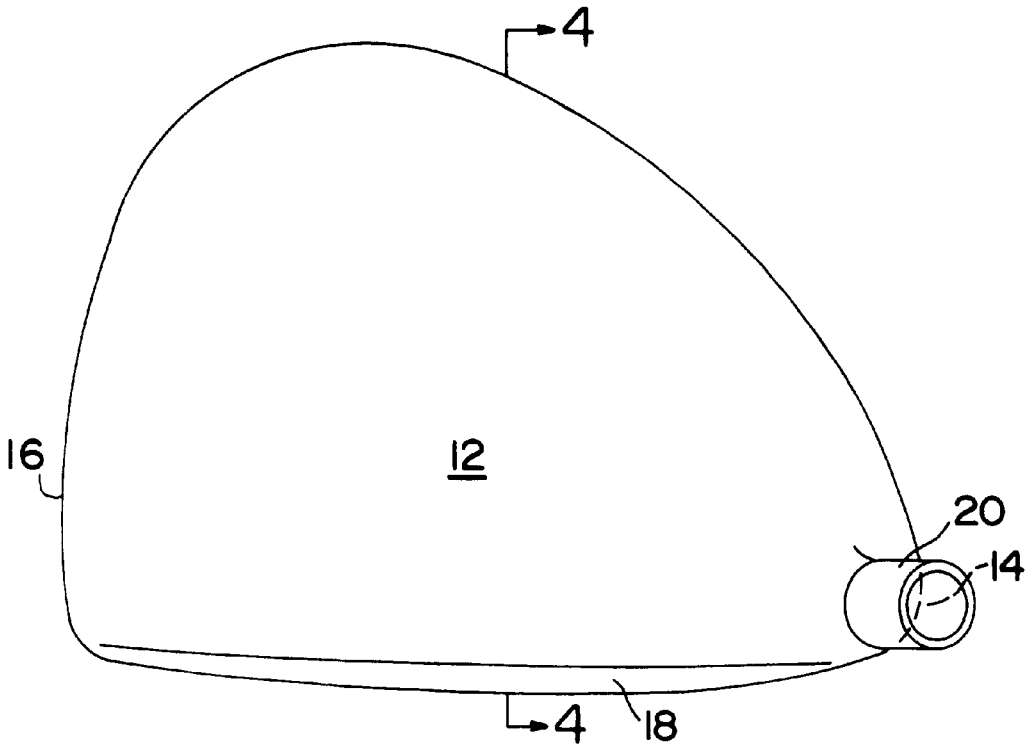
FIG. 1 is a plan view of a first embodiment of a driver clubhead according to the invention.
Figure 2:
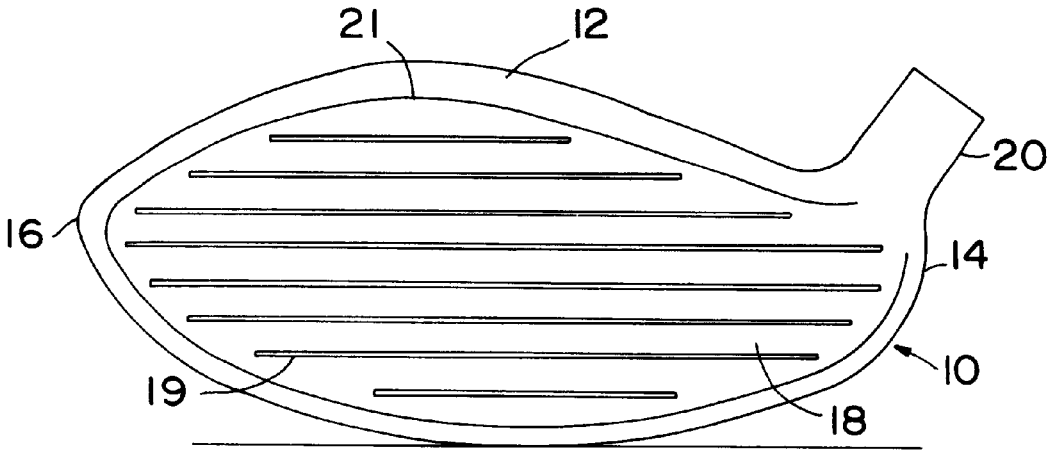
FIG. 2 is front view of the clubhead.
Figure 3:
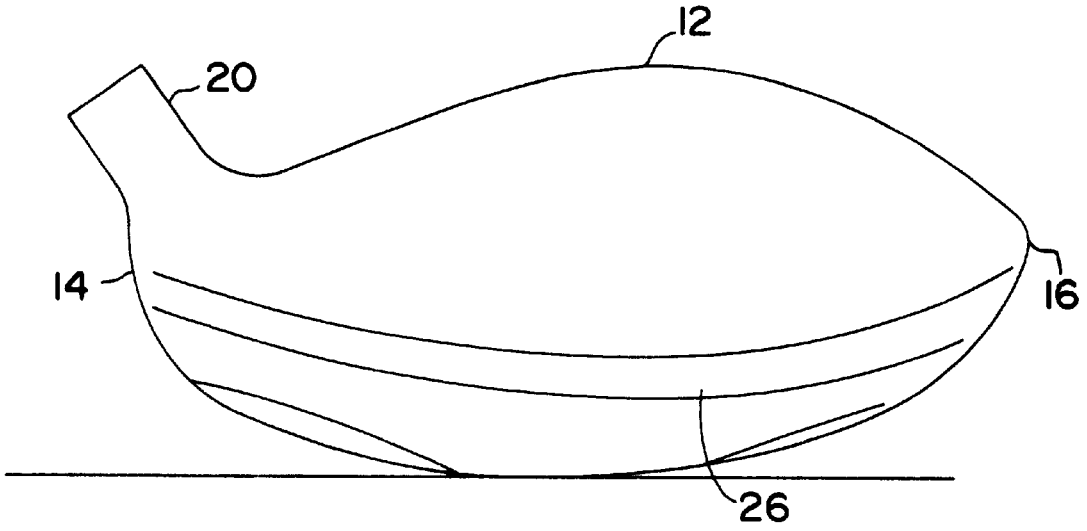
FIG. 3 is a rear view of the clubhead.

FIGS. 1–7 show an example of a driver clubhead having a metal shell 10 defining a top surface 12, a heel 14, a toe 16, a front face 18, and an inset hosel 20 extending from the top surface 12. The shell 10 defines a hollow interior, but which may include reinforcement members in a known manner. In the exemplary embodiment, the front face 18 has a loft angle α (see FIG. 5) of 10 degrees, and a height "H" (see FIG. 5) of 45.45 mm. Drivers, however, can vary in loft angles, and other conventional loft angles can be employed. The example clubhead has a plurality of grooves 19 formed in the front face so as to be parallel to the ground when the club is resting on its touchpoint in its normal address position (shown in FIG. 2). As shown, the upper edge of the front face is curved, and has a vertical apex 21 (the highest vertical point) which is offset from the touchpoint in the direction of the toe.

Figure 4:
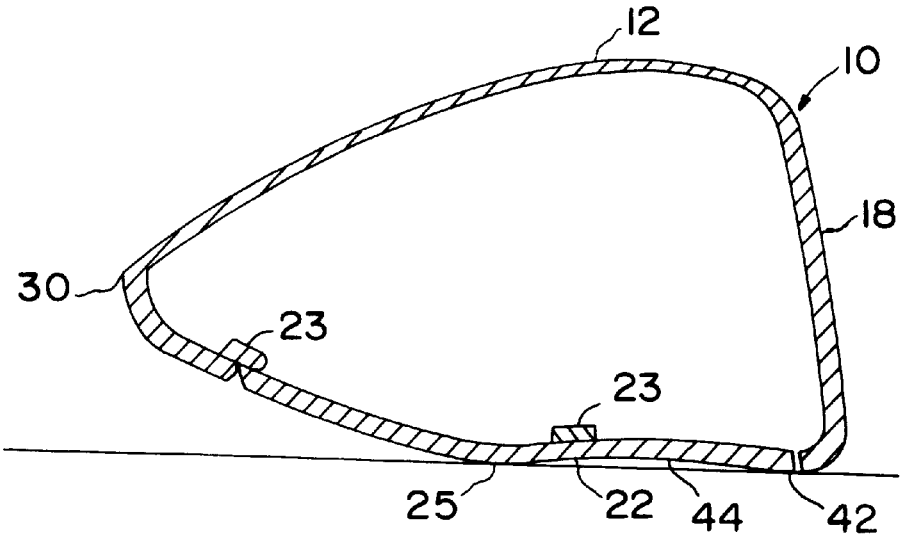
FIG. 4 is a cross-sectional view of the clubhead, taken through lines 4—4 of FIG. 1.
Figure 6:
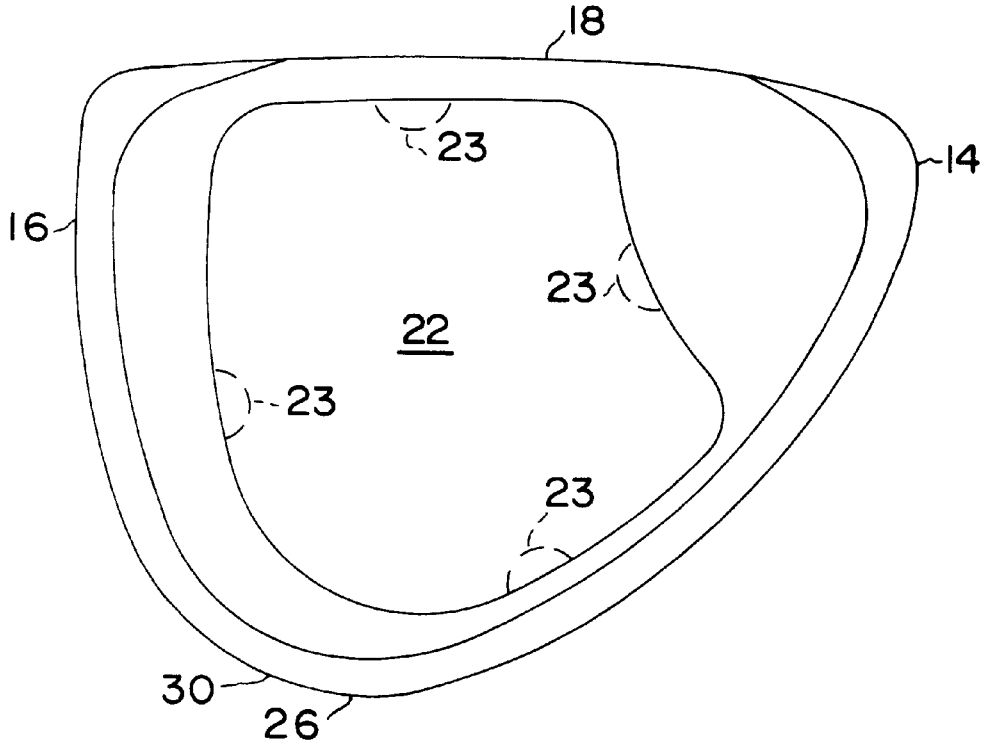
FIG. 6 is a bottom view of the clubhead.

As shown in FIGS. 4 and 6, a sole plate 22 is affixed to the main shell 10, for example by welding in a known manner. A plurality of support tabs 23, extending from the bottom portion of the shell 10, may be used to position the sole plate 22 prior to welding. The sole plate 22 can have any desirable shape.

Figure 7:
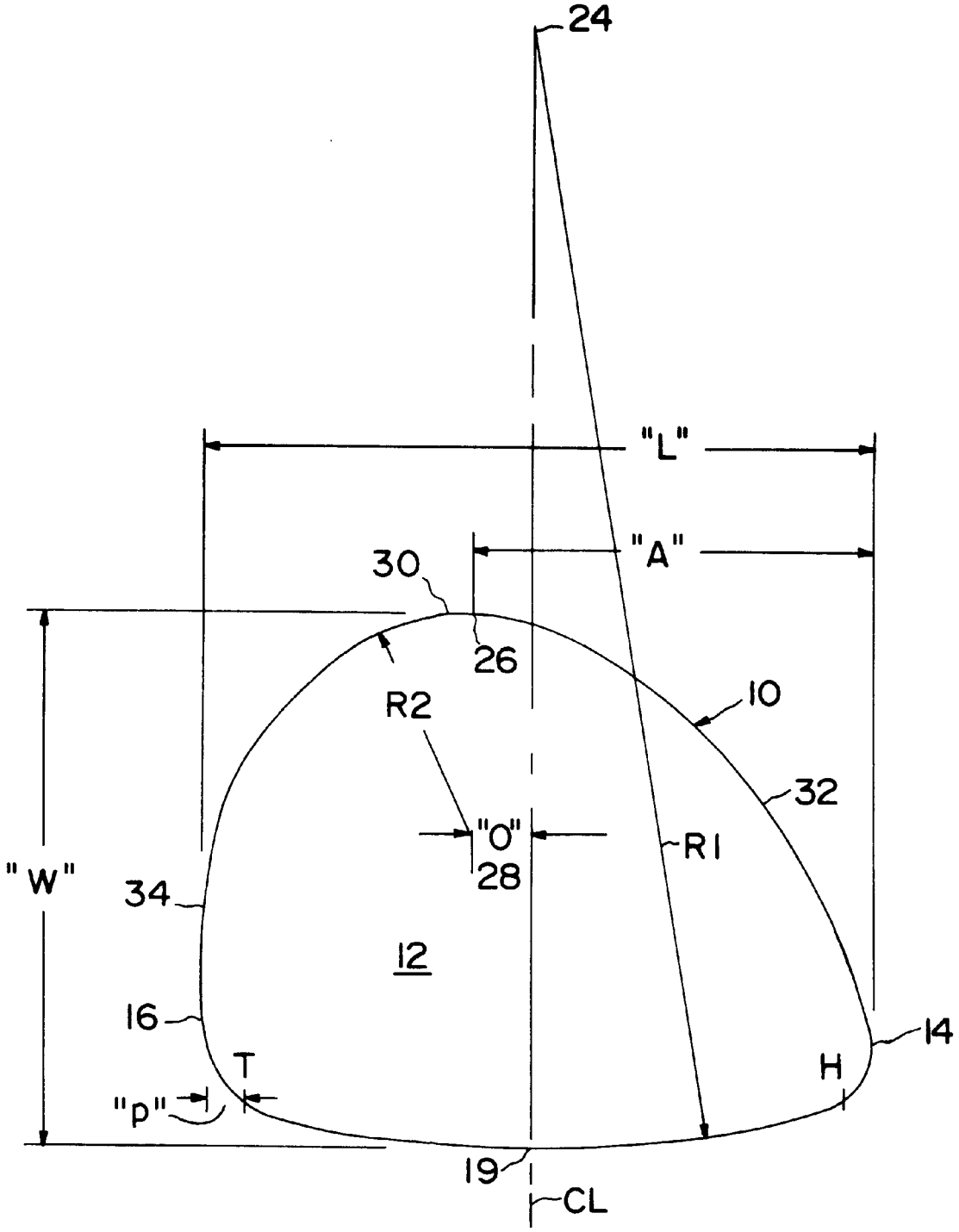
FIG. 7 is a plan view of the clubhead, without the hosel, showing the outline of the head shape projected onto a plane.

Referring to FIG. 7, the clubhead, when projected onto a plane, is shaped so as to have a continuous curvature of varying radii. The front face 18 is a region of constant, relatively large radius of curvature R1 (known as "bulge"), about a center of curvature 24, that extends between points "T" and "H". The rear edge 30 of the clubhead, in the region to either side of the rearmost point 26, has a smaller radius of curvature R2. The edges of the intermediate portions 32, 34 of the clubhead, connecting rear edge 30 with the heel 14 and toe 16, respectively, have a substantially larger radius of curvature than the rear edge 30.

The centerline "CL" of the club extends perpendicular to the club face 18, at its forward-most point 19 when the club is at the normal address position, so as to intersect the center of rotation 24. In the exemplary embodiment, the centerline CL is disposed approximately midway between "T" and "H". The clubhead has a length "L", which is the distance, measured perpendicular to the centerline CL, between the heel 14 and toe 16. The width "W" of the clubhead is the distance, measured parallel to the centerline, between the front face 18 and the rearmost point 26 on the rear edge 30. Finally, the rearmost point 26 lies at a distance "A", measured perpendicular to the centerline CL, from the heel 14. The rearmost point 26, and the center of curvature 28 of R2, are offset from the clubhead centerline CL toward the toe by a distance "O".

In the exemplary embodiment, the clubhead has a length "L" of 109.3 mm, a width "W" of 88.0 mm, a club face radius of curvature R1 of 278.3 mm, a club face length (distance between the toe end "T" and the heel end "H" of the club face) of approximately 90 mm, and a radius of curvature R2, in the region of the rearmost point 26, of 40.3 mm. The rearmost point 26 lies at a distance "A" of 64.3 mm from the heel 14, and the rearmost point 26 and center of curvature 28 of R2 are offset from the clubhead centerline CL by a distance "O" of 9.9 mm. The clubhead, viewed in plan view, covers an area of 7126 $mm^2$, and the clubhead occupies a total volume of 240 $cm^3$. The club face 28 has an area of 3400 $mm^2$.

In accordance with one aspect of the invention, the distance "A" from the heel to the rearmost point 26 on the rear surface 30 is at least 60 mm and/or at least 56% of the overall clubhead length "L". In accordance with another aspect of the invention, the clubhead has a volume of at least 180 $cm^3$, the center of curvature 28 of the rear edge, in the region of the rearmost point 26, is offset from the club's centerline CL toward the toe, and the radius of curvature R2 in the region of the rearmost point 26 is less than 41 mm. And, in accordance with another aspect of the invention, the vertical apex 21 of the front face is offset toward the toe of the club, preferably by a distance of approximately 14 mm.

Figure 5:
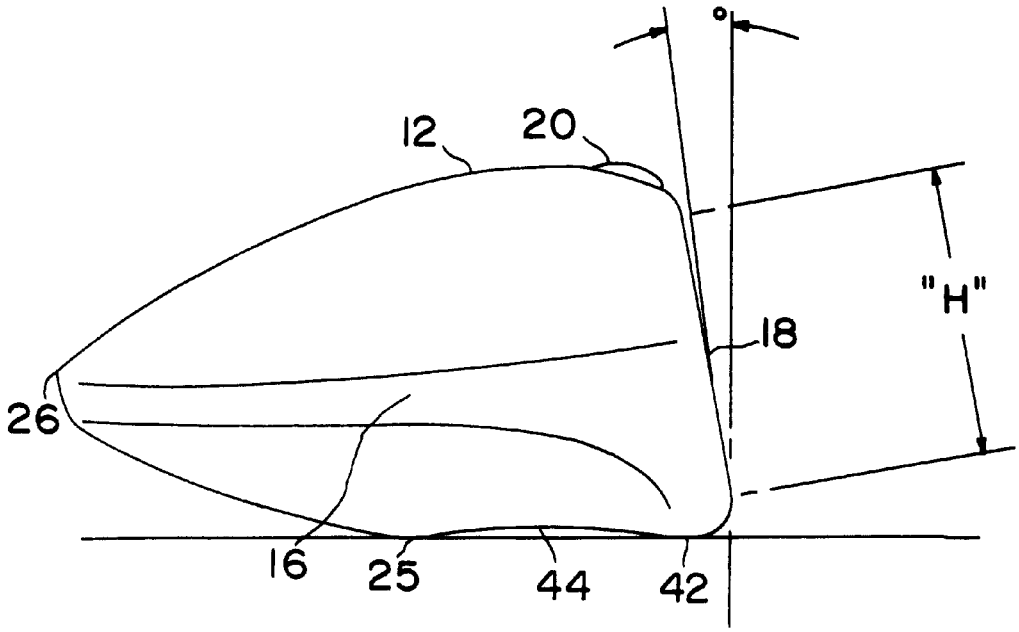
FIG. 5 is side view of the clubhead looking in a direction toward the toe.

As shown in FIGS. 4 and 5, the bottom surface of the clubhead has a pair of ribs 25, 42, separated by a slightly concave surface 44. The ribs 25, 42 run in a direction parallel to the club face, and form a pair of runners so that, when the lie angle of the club changes (as happens with golfers of different height), the face angle does not.

As can be seen from FIG. 1, the geometry of the present clubhead has tendency to locate more mass towards the toe 16 due to the shape of the head, and therefore move the center of gravity toward the toe. This produces a more solid impact for balls hit near the toe. In addition, the vertical apex 21 of the club face is offset towards the toe, also approximately in the location where the ball tends most to be hit, to provide a bigger target to hit the ball. At the same time, despite the higher center of gravity, the clubhead is easier to square during the forward swing, due to the inset location of the hosel. The clubhead is preferably utilized with a lightweight shaft, which combination of features make the club easier to swing.

Referring again to FIG. 7, the toe 16 projects only a short distance "P" forward (i.e., in a lengthwise direction) of the toe end "T" of the club face 18. This is due to the fact that, beyond the toe end "T", the body of the clubhead bends relatively sharply and then extends nearly straight back, i.e., perpendicular to the face of the club. In this example, the distance "P" is approximately 6 mm. The result of this geometry is that the ratio of the club face area to the overall volume of the club, 14.2, is considerably larger than conventional clubs.

Figure 8:
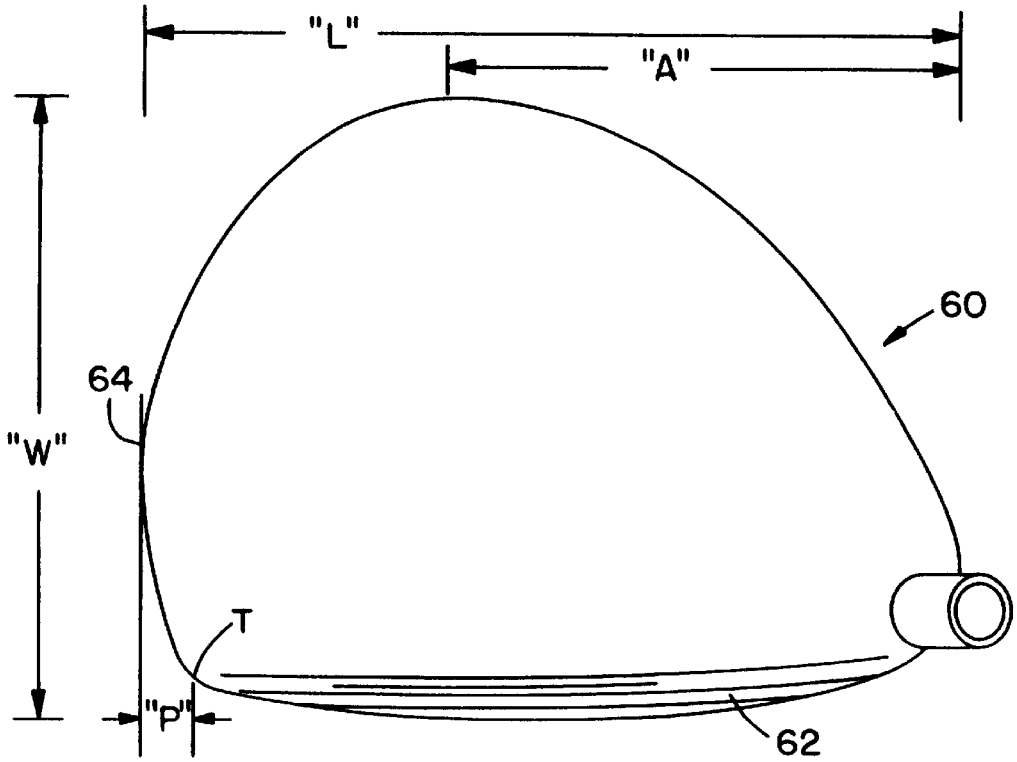
FIG. 8 is a plan view of a second embodiment of a driver clubhead according to the invention.
Figure 9:
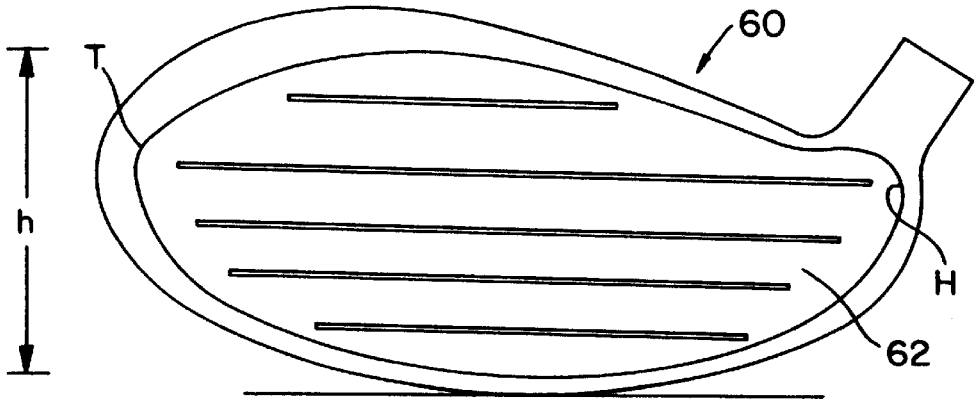
FIG. 9 is front view of the clubhead.

FIGS. 8–9 show a second embodiment of a clubhead 60 which is generally the same in overall geometric configuration as FIGS. 1–7. In the case of the clubhead 60, the face has an area of 4000 $mm^2$, and an overall volume of 290 cc. The height of the club face 62 is 50 mm, and the length of the club face (distance between the heel end "H" and toe end "T") is 110 mm. The distance "P" between the toe end "T" and the forwardmost point 62 of the toe is in the range of 4.6–5.6 mm. The clubhead has an overall length "L" of 115 mm, and a distance "A" of approximately 80 mm.

The head shape of the present invention was compared with other woods on the market, with the differences represented in the table below.

TABLE 1

| Model | Dimension A mm | Dimension B mm | A/L | Dimension R2 mm | P |
|---|---|---|---|---|---|
| Invention FIGS. 1–7 | 64.3 | 109.3 | 0.588 | 40.3 | 4.0 |
| Invention FIGS. 8–9 | 80 | 115 | 0.7 | | 4.6–5.6 |

TABLE 1-continued

| Model | Dimension A mm | Dimension B mm | A/L | Dimension R2 mm | P |
|---|---|---|---|---|---|
| Callaway Ti Great Big Bertha | 57.1 | 109.0 | 0.524 | 46.3 | 12.7 |
| Callaway stainless Big Bertha | 56.7 | 104.5 | 0.543 | 44.5 | |
| Callaway #7 Heaven Wood | 50.8 | 91.7 | 0.554 | 38.2 | |
| Taylor Made Ti Bubble | 58.1 | 106.3 | 0.547 | 47.4 | 6.1 |
| PRGR Data Wood | 56.2 | 110.7 | 0.508 | 43.6 | |
| Callaway Biggest Big Bertha | | | | | 15.2 |
| Taylor Made Burner Bubble | | | | | 12.7 |
| Taylor Made BB Ti2 | | | | | 10.16 |
| Goldwin XL | | | | | 8.6 |

The foregoing represents preferred embodiments of the invention. Variations and modifications will be apparent to persons skilled in the art, without departing from the inventive concepts disclosed herein. All such modifications and variations are intended to be within the skill of the art, as defined in the following claims.

We claim:

1. A metal wood golf clubhead having a front face with a forward-most point and a centerline extending perpendicular thereto, a heel, a toe, and a rear edge having a rearmost point; wherein said rear edge extends, from said heel to said toe, alone a continuous convex curve, wherein said clubhead has a length "L" representing the distance, measured perpendicular to said centerline, between said heel and toe, and wherein said rearmost point lies at a distance "A", measured perpendicular to said centerline, from said heel; and wherein said distance "A" is greater than 60 mm.

2. A metal wood golf clubhead according to claim 1, wherein said distance "A" is approximately 64 mm.

3. A metal wood golf clubhead according to claim 2, wherein said length "L" is greater than 100 mm.

4. A metal wood golf clubhead according to claim 3, wherein said length "L" is approximately 109 mm.

5. A metal wood golf clubhead according to claim 1, wherein said length "L" is greater than 100 mm.

6. A metal wood golf clubhead according to claim 5, wherein said length "L" is approximately 109 mm.

7. A metal wood golf clubhead according to claim 1, wherein the ratio of said distance "A" to said length "L" is at least 0.56.

8. A metal wood golf clubhead according to claim 7, wherein the ratio of said distance "A" to said length "L" is approximately 0.6.

9. A metal wood golf clubhead according to claim 7, wherein the length "L" is at least 100 mm.

10. A metal wood golf clubhead according to claim 9, wherein the length "L" is approximately 109 mm.

11. A metal wood golf clubhead according to claim 1, wherein said rear edge, in the region of said rearmost point, has a radius of curvature R2 having a center of rotation offset from said centerline in the direction of said toe, wherein said clubhead occupies an overall volume of at least 180 cubic centimeters, and wherein said radius of curvature R2 is less than 41 mm.

12. A metal wood golf clubhead according to claim 11, wherein said radius of curvature R2 is approximately 40 mm.

13. A metal wood golf clubhead according to claim 11, wherein said length "L" is greater than 100 mm.

14. A metal wood golf clubhead according to claim 13, wherein the ratio of said distance "A" to said length "L" is at least 0.56.

15. A metal wood golf clubhead according to claim 11, wherein said radius of curvature R2 is approximately 40 mm, wherein said length "L" is approximately 109 mm, and wherein the ratio of said distance "A" to said length "L" is approximately 0.6.

16. A metal wood golf clubhead having a front face with a forward-most point and a centerline extending perpendicular thereto, a heel, a toe, and a rear edge having a rearmost point; wherein said rear edge extends, from said heel to said toe, along a continuous convex curve wherein said clubhead has a length "L" representing the distance, measured perpendicular to said centerline, between said heel and toe, and wherein said rearmost point lies at a distance "A", measured perpendicular to said centerline, from said heel, and wherein the ratio of said distance "A" to said length "L" is at least 0.56.

17. A metal wood golf clubhead according to claim 16, wherein the ratio of said distance "A" to said length "L" is approximately 0.6.

18. A metal wood golf clubhead having a front face with a forward-most point and a centerline extending perpendicular thereto, a heel, a toe, and a rear edge having a rearmost point; wherein said rear edge, in the region of said rearmost point, has a radius of curvature R2 having a center of rotation offset from said centerline in the direction of said toe, wherein said clubhead occupies an overall volume of at least 180 cubic centimeters, and wherein said radius of curvature R2 is less than 41 mm.

19. A metal wood golf clubhead according to claim 18, wherein said radius of curvature R2 is approximately 40 mm.

20. A metal wood golf clubhead having a touchpoint and a centerline extending vertically therethrough, and a rear edge which extends from said heel to said toe along a continuous convex curve, and further comprising a front face having a vertical apex, a heel, and a toe, wherein said vertical apex is offset from said centerline, in a direction perpendicular to said centerline toward said toe, a distance of at least 10 mm.

21. A metal wood golf clubhead according to claim 20, wherein said vertical apex is offset by a distance of approximately 14 mm.

22. A metal wood golf clubhead having a body and a front face, the front face having a toe end "T" lying furthest from the heel, and said body having a forwardmost point, wherein said body curves relatively sharply forward of said toe end "T" to extend rearwardly, wherein said body has a volume of at least 240 cc, wherein said clubhead has a rear edge which extends from said heel to said toe along a continuous convex curve, and wherein the distance between the toe end "T" and the forwardmost point is less than 6 mm.

23. A metal wood golf clubhead according to claim 22, wherein said face has an area greater than 3800 $mm^2$.

24. A metal wood golf clubhead according to claim 22, wherein said face has an area of at least 3400 $mm^2$ and a volume less than 250 cc.

25. A metal wood clubhead according to claim 22, wherein said clubhead has a face-to-volume ratio greater than 13:1 and a volume greater than 250 cc.

* * * * *